United States Patent [19]

Pearson

[11] Patent Number: 5,065,845

[45] Date of Patent: Nov. 19, 1991

[54] SPEED GOVERNOR SAFETY DEVICE FOR STOPPING AN ELEVATOR CAR

[76] Inventor: David B. Pearson, 796 Lynwood St., Raitan, N.J. 08869

[21] Appl. No.: 582,428

[22] Filed: Sep. 13, 1990

[51] Int. Cl.[5] ..... B66B 5/22

[52] U.S. Cl. ..... 187/89; 188/38; 188/44; 188/180

[58] Field of Search ..... 187/38, 77, 78, 80, 187/89, 90, 91; 188/38, 44, 67, 180, 188

[56] References Cited

U.S. PATENT DOCUMENTS

| | | | |
|---|---|---|---|
| 3,934,682 | 1/1976 | Hedstrom | 187/89 |
| 4,029,177 | 6/1977 | Fiss | 187/89 |
| 4,538,706 | 9/1985 | Koppensteiner | 187/90 |
| 4,662,481 | 5/1987 | Morris et al. | 187/77 |

*Primary Examiner*—David H. Bollinger
*Assistant Examiner*—Dean A. Reichard

[57] ABSTRACT

A safety apparatus includes a safety device and a centrifugal force speed governor for preventing overspeed conditions of an elevator car in both the downward direction and the upward direction. A bracket attached to the elevator car slidably retains a shaft at right angle to a guide rail attached to an elevator shaft wall. A U-shaped frame is attached to an end of the shaft and rotatably carries a running wheel. A compression spring extends over the shaft between the bracket and the frame to bias the running wheel against the web of the guide rail. On each side of the running wheel, a pair of release levers are rotatably supported to rotate during travel of the car in normal operation. In response to an overspeed condition, the release levers pivot into engagement with a pair of stationary ratchet wheels which are connected with a pair of actuating levers. The ratchet wheels are rotated by the running wheel which movement rotates the actuating levers. The actuating levers each move a release arm and one of the levers is connected to an actuating rod, which in turn is in connected to a release arm of another safety device on the car. The release arms extend into a wedge box of the safety device to actuate wedge-shaped jaws to engage the guide rail. For resetting the safety apparatus, the elevator car is restarted after a safety stop in the opposite direction of travel.

20 Claims, 3 Drawing Sheets

SPEED GOVERNOR SAFETY DEVICE FOR STOPPING AN ELEVATOR CAR

BACKGROUND OF THE INVENTION

The present invention relates in general to safety devices for stopping elevator cars and, in particular, to such safety devices actuated by a speed governor mounted on the elevator car.

The U.S. Pat. No. 4,662,481 discloses a safety device having a speed governor mounted on an elevator car, which device prevents excessive speed of the elevator car during downward travel. The speed governor is essentially a spring cylinder pivotally supported at one end on the elevator car and attached at the other end to a fork shaped frame, which frame carries external rotatable and internal fixed concentric cylinders. The frame is also connected with the safety device by an actuating rod. The rotatable cylinder has a peripheral groove corresponding in cross section to the profile of the guide rail. The spring cylinder biases the roller cylinder to engage the groove with the guide rail so that travel by the elevator car rotates the rotatable cylinder. A release mechanism with centrifugal weights is positioned in the interior of the rotatable cylinder to monitor the speed of the car. In the case of excessive speed of the car in the downward direction, the release mechanism locks the rotatable cylinder to the fixed cylinder. Friction between the guide rail and the locked rotatable cylinder causes an upward relative motion about the pivot point of the spring cylinder thereby triggering actuation of the safety device through the actuating rod. The spring cylinder is blocked from pivoting when the car is travelling in the upward direction. This safety device is to a great extent similar in operation to the prior art safety devices triggered by a limiter rope.

The release mechanism positioned in the interior of the rotatable cylinder has a pair of weights tensioned initially by a spring, which weights rotate with the rotatable cylinder. As the weights move outwardly, due to the centrifugal forces generated by rotation of the cylinder, a hook shaped end on each weight engages teeth formed on the internal fixed cylinder.

A drawback of the above described safety device is the complicated mechanical construction of the release mechanism positioned inside the rotatable cylinder. High manufacturing and assembly costs connected therewith increase the cost of the speed governor. A further drawback of this safety device is the large mass to be moved in the case of breakdown. Furthermore, the speed governor can be relied upon only if sufficient friction exists between the guide rail and the rotatable cylinder, which condition requires periodic cleaning of the guide rails.

SUMMARY OF THE INVENTION

The present invention avoids the drawbacks of the above described safety device and provides a safety device which stops the elevator car in response to overspeed in both the downward direction and the upward direction of travel. A speed governor is mounted on an elevator car and includes a running wheel driven by the guide rail and rotatably mounted on a U-shaped frame. The frame is attached to the car and biased to engage the wheel with the guide rail. A release mechanism, operated by centrifugal force, is mounted on the wheel for actuating a safety device in case of excessive velocity of the car in either direction of travel.

An advantage of the present invention is that the speed governor is independent of the direction of travel of the car and can be located near to the safety device, that few moving parts are required to initiate the triggering process, that simple mechanical construction permits the entire assembly to be performed at the factory, and that a complete adjustment of the safety device and of the speed governor to the car can be carried out simply at the factory.

The safety device according to the present invention includes a wedge box attached to the elevator car and forming a pair of tracks, a pair of wedge-shaped jaws each movable along one of the tracks, a pair of release arms each having a release finger extending into the wedge box for moving an associated one of the jaws along the associated track in a direction depending upon the direction of travel of the car in response to an overspeed condition of the car, a pair of adjusting springs for each of the release fingers and adjusting screws engaging the adjusting springs for setting a stopping distance for the elevator The speed governor according to the present invention has a running wheel rotatably mounted on an axle attached to a U-shaped frame, the wheel being biased against and driven by the guide rail for the elevator car in an elevator shaft and the U-shaped frame being attached to an axially slidable shaft, the slidable shaft being guided by a bracket attached to the elevator car, a pair of ratchet wheels fixedly attached to the axle on opposite sides of the running wheel, a pair of centrifugal force operated release levers attached to each side of the running wheel which during normal operation of the elevator car rotate around the associated ratchet wheel, a pair of actuating levers attached to the axle on opposite sides of the running wheel, and one of the release arms connected between each of the actuating levers and the safety device whereby upon the occurrence of an overspeed condition of the car, the release levers engage the ratchet wheels and the actuating levers rotate to move the release arms and actuate the safety device.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
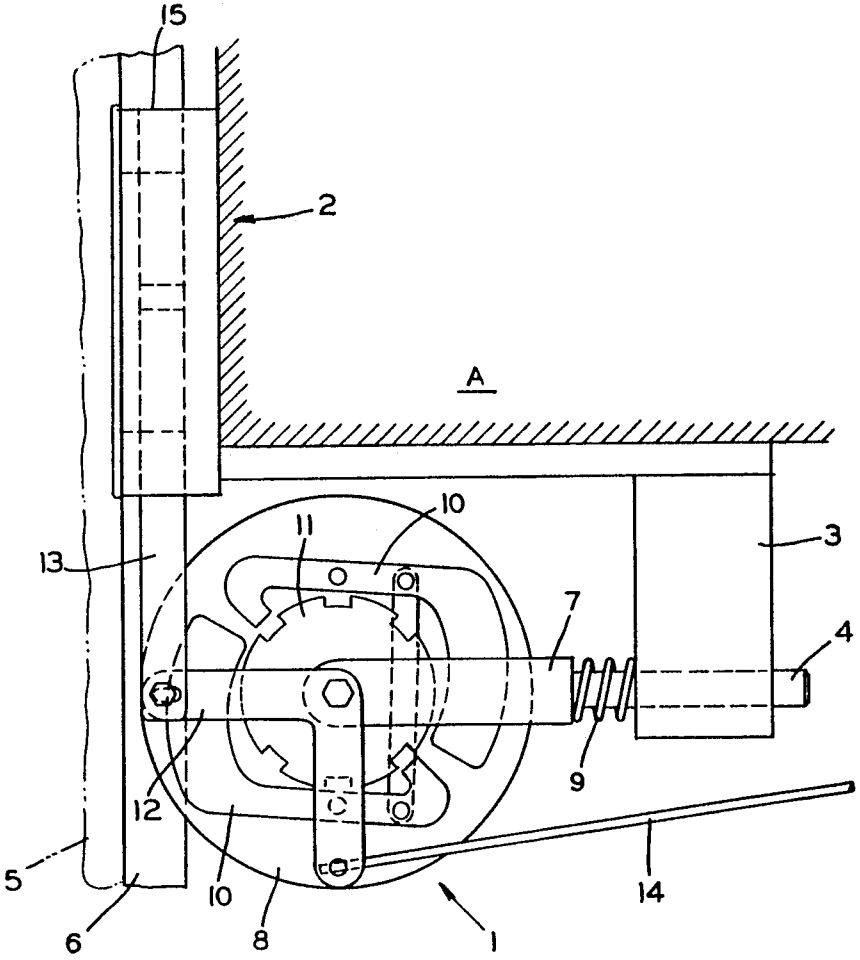
FIG. 1 is a side elevational view of a schematic representation of a safety device according to the present invention with a speed governor mounted on an elevator car.

Designated with 1 in the FIGS. 1 to 4 is a centrifugal force speed governor which prevents excessive speeds of an elevator car A, independent of the direction of travel, in cooperation with a safety device 2. A bracket 3 is attached to a bottom side of the elevator car A and slidably supports one end of a shaft 4 which extends generally horizontally at a right angle to a guide rail 6 attached to and extending vertically along a wall 5 of an elevator shaft in which the elevator car operates. The other end of the shaft 4 is attached to a center portion of a generally U-shaped frame 7 which rotatably mounts a running wheel 8 between the free ends of a pair of spaced apart arms. The shaft 4 extends through a compression spring 9 which is trapped between the bracket 3 and the frame 7 so that the axially movable shaft 4 and the frame 7 are biased in the direction of the shaft wall 5 whereby a periphery of the running wheel 8 is pressed against a facing edge of the guide rail 6.

On each side of the running wheel 8, a pair of release levers 10 are attached which levers selectively act on an associated one of a pair of ratchet wheels 11. The release levers 10 are rotated with the running wheel 8 during car travel and, during normal operation, each pair of the release levers rotates around the associated one of the ratchet wheels 11. Each of the ratchet wheels 11 is fixedly attached at a center point to an associated one of a pair of actuating levers 12 and 12', the actuating lever 12 having two arms defining an approximate right angle. Any movement of the actuating lever 12 is transferred by one generally horizontally extending arm to an attached release arm 13 and by the other generally vertically extending arm to an attached actuating rod 14, which rod 14 is connected with the release arm (not shown) of a similar safety device (not shown) mounted on the opposite side of the elevator car A. The release arm 13 extends generally parallel to the guide rail 6 into a wedge box 15 of the safety device 2. In order to reset the safety device 2, the elevator car A is moved in a direction opposite to the direction of travel existing when an overspeed problem caused the car to be stopped.

Figure 3:
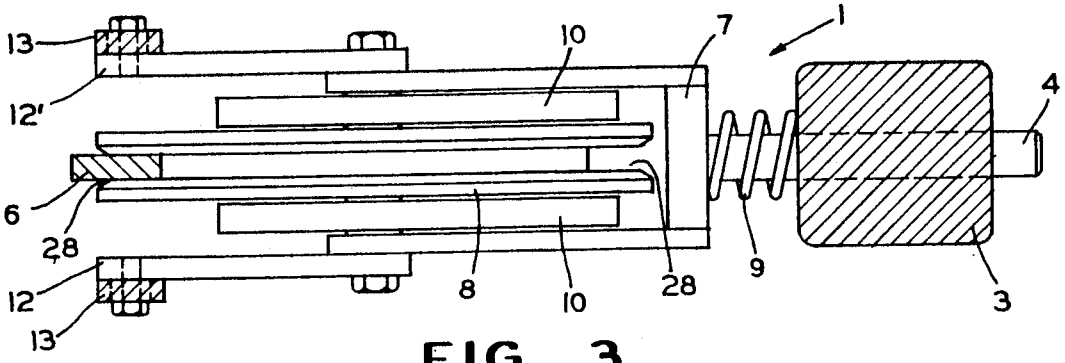
FIG. 3 is an enlarged top plan view of the speed governor shown in the FIGS. 1 and 2.
Figure 4:
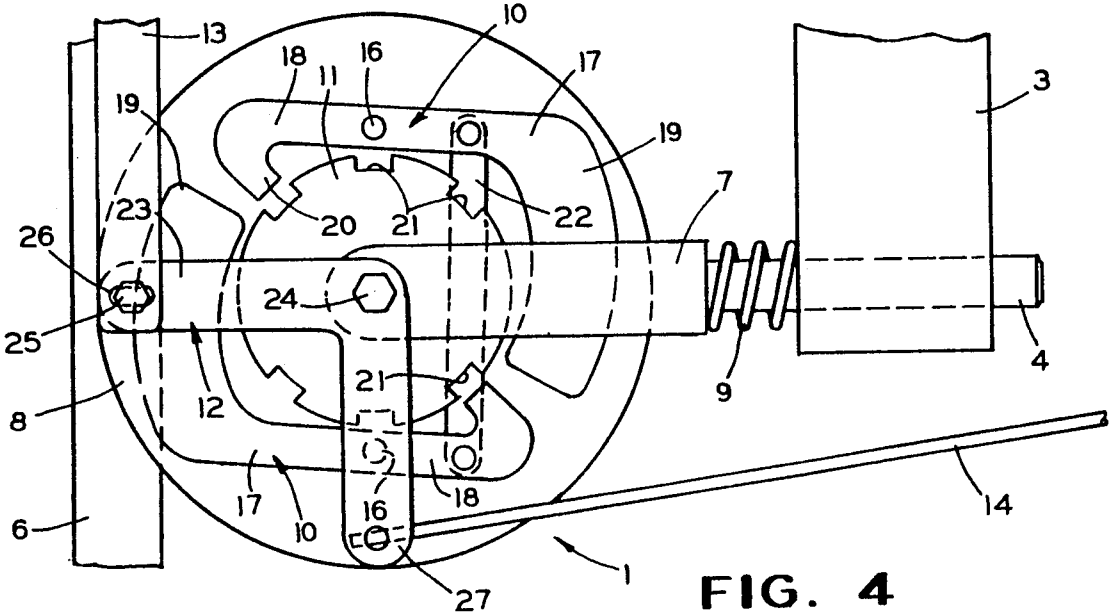
FIG. 4 is an enlarged side elevational view of the speed governor shown in the FIGS. 1 and 2.

As best shown in the FIGS. 3 and 4, the release levers 10 of each pair are each rotatably supported on an associated one of a pair of diametrically opposed pivot pins 16 attached to the wheel 8. Each of the levers 10 has a first arm 17 extending from the pivot pin 16 and a second arm 18 extending from the pivot pin 16 in a direction opposite to the first arm. Each of the first arms 17 ends in a centrifugal weight 19, which weight moves radially dependent on the rotational velocity of the running wheel 8. A pawl 20 is formed at the free end of each of the second arms 18 and, in the case of overspeed by the elevator car, each of the release levers 10 is rotated about the associated pivot pin 16 by the attached weight 19. At a preselected speed, the pawls 20 engage in an adjacent one of a plurality of indentations 21 formed in a periphery of the associated ratchet wheel 11, whereby the ratchet wheels 11 are set into rotational motion with the wheel 8. The release levers 10 in each pair of the release levers are connected together flexibly by an equalizing bar 22, which bar transfers an initial biasing force produced by a not illustrated spring, from one release lever 10 to the other release lever 10 of the pair.

Figure 2:
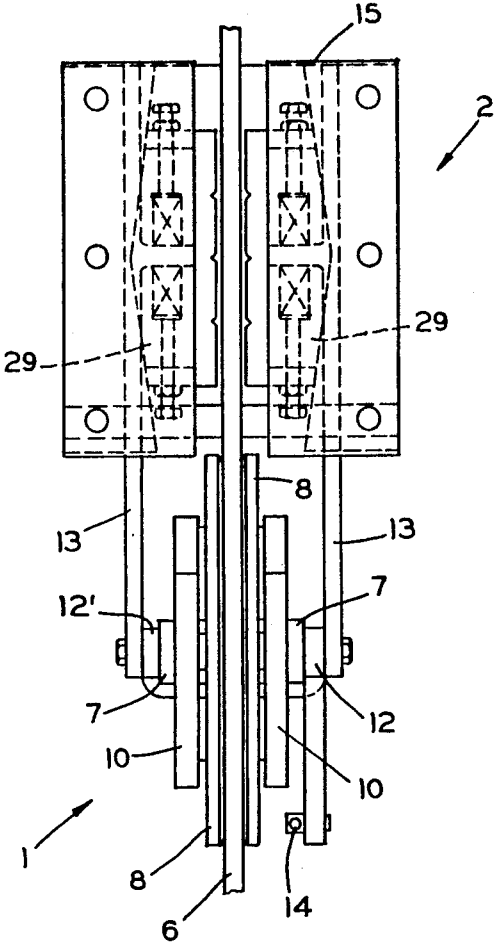
FIG. 2 is a front elevational view of the safety device and the speed governor shown in the FIG. 1.

A generally horizontally extending first arm 23 of the actuating lever 12 has one end attached to a wheel axle 24 on which the running wheel 8 is rotatably mounted and carries a bolt 25 at its free end, which bolt engages an horizontally extending longitudinal slot 26 formed at a lower end of the associated release arm 13 A generally vertically extending second arm 27 of the actuating lever 12 has one end attached to the wheel axle 24 and a free end pivotally attached to an adjacent end of the actuating rod 14 The other actuating lever 12' is similar to the arm 23 and is connected between the wheel axle 24 and another release arm 13 as shown in the FIGS. 2 and 3. The running wheel 8, which is rotatably supported by the U-shaped frame 7, has a circumferentially extending groove 28 formed in a periphery thereof the groove corresponding in cross section to the profile of the facing web of the guide rail 6. As stated above the running wheel 8 is biased into contact with the guide rail 6 and is rotated as the elevator car A travels in the elevator shaft, the speed of rotation of the running wheel 8 being proportional to the speed of the elevator car.

Figure 5:
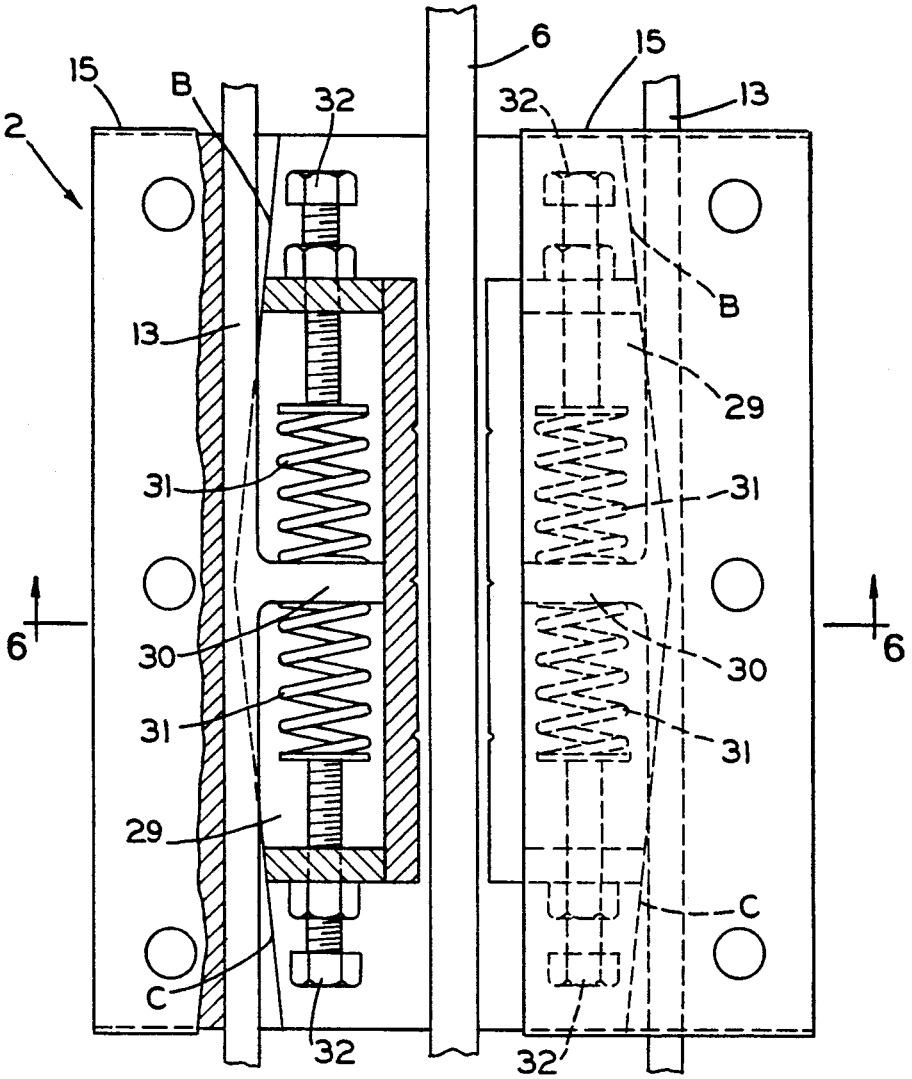
FIG. 5 is an enlarged front elevational view of the safety device shown in the FIGS. 1 and 2.
Figure 6:
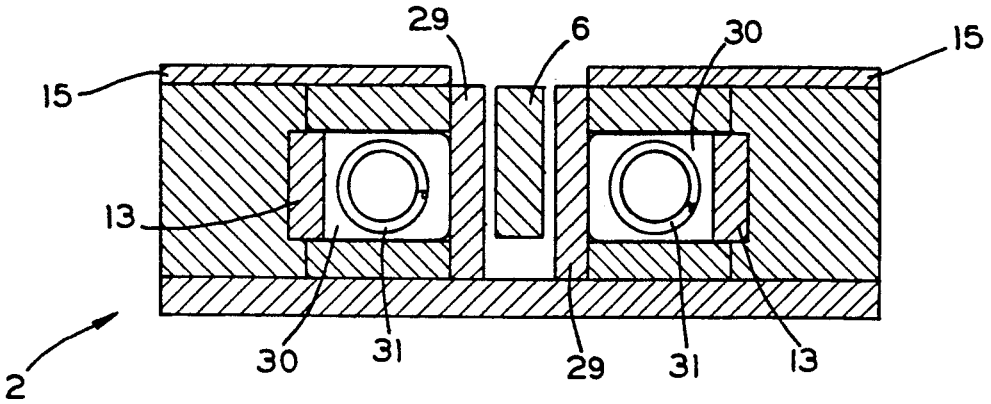
FIG. 6 is a cross-sectional view the safety device taken along the line 6—6 in the FIG. 5.

As best shown in the FIGS. 5 and 6, the wedge box 15 of the safety device 2 has a pair of wedge-shaped jaws 29, one jaw positioned on each side of the guide rail 6. In the case of an overspeed condition of the elevator car depending on the direction of travel each of the jaws 29 moves upwardly or downwardly and is forced laterally into contact with the guide rail 6. During the downward direction of travel, the jaws 29 will be forced upwardly on a track B fixed portion of the wedge box 15. During the upward direction of travel the jaws 29 will be forced downwardly on a track C fixed portion of the wedge box 15 The wedge-shaped jaws 29 are actuated by associated ones of a pair of generally horizontally extending release fingers 30 attached to associated ones of the release arms 13. The fingers 30 are centrally aligned in the jaws 29 by associated pairs of generally vertically extending adjusting springs 31, one spring above and one spring below each finger. The specified stopping distance for the elevator car is adjustable by utilizing compensating bolts 32 threadably engaging the jaws 29 and extending into engagement with associated ones of the adjusting springs 31. The opposing forces generated by the springs 31 limit the travel of the jaws 29 and thus limit the stopping forces exerted on the guide rail 6.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An apparatus for stopping an elevator car comprising: a safety device for engaging an elevator guide rail to stop an elevator car; and a speed governor having a running wheel rotatably mounted on an axle attached to a U-shaped frame, said wheel being biased against and driven by the guide rail for the elevator car in an elevator shaft and said U-shaped frame being attached to an axially slidable shaft, said slidable shaft being guided by a bracket adapted to be attached to the elevator car, a ratchet wheel fixedly attached to said axle, at least one pair of centrifugal force operated release levers attached to said running wheel which during normal operation of the elevator car rotate around said ratchet wheel, an actuating lever attached to said axle, and a release arm connected between said actuating lever and said safety device whereby upon the occurrence of an overspeed condition of the car in either direction of travel of the car, said release levers engage said ratchet wheel causing said ratchet wheel to rotate in a direction corresponding to the direction of travel of the car, said ratchet wheel further causing said actuating lever to be rotated in a direction corresponding to the direction of travel of the car to move said release arm in a direction associated with the direction of travel of the car and actuate said safety device.

2. The apparatus according to claim 1 including a compression spring through which said slidable shaft extends and is trapped between said U-shaped frame and said bracket for biasing said running wheel against the guide rail.

3. The apparatus according to claim 1 wherein a pair of said release levers is attached to each side of said running wheel and said release levers of each said pair are connected together by an equalizing bar.

4. The apparatus according to claim 3 wherein said release levers are each pivotally attached to said running wheel and have a centrifugal weight formed on a first arm and a pawl formed on a second arm, said pawls being moved toward said ratchet wheel under increased rotational velocity of said running wheel.

5. The apparatus according to claim 1 including a pair of said ratchet wheels one of said ratchet wheels fixedly attached to said axle on each side of said running wheel, each of said ratchet wheels having a plurality of indentations formed in a periphery thereof for engaging said release levers.

6. The apparatus according to claim 1 wherein said actuating lever is a first actuating lever having a first arm connected to said release arm and a second arm and being attached to said axle on one side of said running wheel and including a second actuating lever attached to said axle on the other side of said running wheel and having a first arm connected to another one of said release arms.

7. The apparatus according to claim 6 including a bolt attached at a free end of said first arm of each of said actuating levers, each said bolt engaging a longitudinal slot formed at a lower end of one of said release arms connected to an associated one of said first arms.

8. The apparatus according to claim 6 including an actuating rod attached to a free end of one of said second arms for transferring movement of said release arm to a second safety device.

9. The apparatus according to claim 1 wherein said safety device has a wedge box forming a track and a wedge-shaped jaw movable along said track and wherein said release arm has a release finger extending into said wedge box for moving said jaw along said track in a direction depending upon the direction of travel of the car in response to an overspeed condition of the car.

10. The apparatus according to claim 9 including a pair of adjusting springs engaging said release finger and adjusting screws engaging said adjusting springs for setting a stopping distance for the elevator.

11. A apparatus for stopping an elevator car comprising:

a safety device for engaging an elevator guide rail to stop an elevator car including a wedge box forming a track and a wedge-shaped jaw movable along said track in a direction depending upon the direction of travel of the car in response to an overspeed condition of the car; and a speed governor having a running wheel rotatably mounted on an axle attached to a U-shaped frame, said wheel being biased against and driven by the guide rail for the elevator car in an elevator shaft and said U-shaped frame being attached to an axially slidable shaft said slidable shaft being guided by a bracket adapted to be attached to the elevator car, a ratchet wheel fixedly attached to said axle, at least one pair of centrifugal force operated release levers attached to said running wheel which during normal operation of the elevator car rotate around said ratchet wheel, an actuating lever attached to said axle and a release arm connected between said actuating lever and said safety device whereby upon the occurrence of an overspeed condition of the car, said release levers engage said ratchet wheel and said actuating lever is rotated to move said release arm and said wedge-shaped jaw.

12. The apparatus according to claim 11 including a compression spring through which said slidable shaft extends and is trapped between said U-shaped frame and said bracket for biasing said running wheel against the guide rail.

13. The apparatus according to claim 11 wherein a pair of said release levers is attached to each side of said running wheel said release levers of each said pair are connected together by an equalizing bar.

14. The apparatus according to claim 13 wherein said release levers are each pivotally attached to said running wheel and have a centrifugal weight formed on a first arm and on a pawl formed on a second arm, said pawls being moved in the direction of said ratchet wheel under increased rotational velocity of said running wheel.

15. The apparatus according to claim 11 including one of said ratchet wheels fixedly attached to said axle on each side of said running wheel, each of said ratchet wheels having a plurality of indentations formed in a periphery thereof for engaging said release levers.

16. The apparatus according to claim 11 wherein said actuating lever is a first actuating lever having a first arm and a second arm and being attached to said axle on one side of said running wheel, and including a second actuating lever attached to said axle on the other side of said running wheel and having a first arm.

17. The apparatus according to claim 16 including a bolt attached at a free end of said first arm of each said actuating lever, and wherein said release arm is a pair of release arms, each said bolt engaging a longitudinal slot formed at a lower end of one of said release arms connected to an associated one of said first arms.

18. The apparatus according to claim 16 including an actuating rod attached to a free end of said second arm for the transferring movement of said release arm to a second safety device.

19. The apparatus according to claim 11 wherein said release arm has a release finger extending into said wedge box for moving said jaw along said track and including a pair of adjusting springs engaging said release finger and adjusting screws engaging said adjusting springs for setting a stopping distance for the elevator.

20. A apparatus for stopping an elevator car including a safety device and a speed governor comprising:

a safety device for engaging an elevator guide rail to stop an elevator car including a wedge box forming a pair of tracks, a pair of wedge-shaped jaws movable along associated ones of said tracks, a pair of release arms each having a release finger extending into said wedge box for moving an associated one of said jaws along said associated track in a direction depending upon the direction of travel of the car in response to an overspeed condition of the car, a pair of adjusting springs for engaging each of said release fingers and adjusting screws engaging said adjusting springs for setting a stopping distance for the elevator; and a speed governor having a running wheel rotatably mounted on an axle attached to a U-shaped frame said wheel being biased against and driven by the guide rail for the elevator car in an elevator shaft and said U-shaped frame being attached to an axially slidable shaft, said slidable shaft being guided by a bracket adapted to be attached to the elevator car, a pair of ratchet wheels fixedly attached to said axle on opposite sides of said running wheel, two pairs of centrifugal force operated release levers attached to opposite sides of said running wheel which during normal operation of the elevator car rotate around an associated one of said ratchet wheels a pair of actuating levers attached to said axle on opposite sides of said running wheel, and one of said release arms connected between each of said actuating levers and said safety device whereby upon the occurrence of an overspeed condition of the car said release levers engage said ratchet wheels and said actuating levers are rotated to move said release arms and said jaws.

* * * * *

UNITED STATES PATENT AND TRADEMARK OFFICE

CERTIFICATE OF CORRECTION

PATENT NO. : 5,065,845

DATED : November 19, 1991

INVENTOR(S) : David B. Pearson

It is certified that error appears in the above-identified patent and that said Letters Patent is hereby corrected as shown below:

On the Title page, item

"[54] Speed Governor Actuated Safety Device For Stopping an Elevator Car"

On the Title page, item

"[73] Assignee: Inventio AG, Switzerland"

"Attorney, Agent, or Firm - Marshall & Melhorn"

Signed and Sealed this

Nineteenth Day of October, 1993

*Attest:*

Bruce Lehman

BRUCE LEHMAN

*Attesting Officer*

*Commissioner of Patents and Trademarks*